US006196700B1

(12) United States Patent
Lai

(10) Patent No.: US 6,196,700 B1
(45) Date of Patent: Mar. 6, 2001

(54) FOLDING PLASTIC SKELETON

(76) Inventor: Wei-Cheng Lai, 9-47 Ho Hsing, Ho Hsing Village, Hu-Kon, Hsinchu Hsien (TW)

( * ) Notice: Subject to any disclaimer, the term of this patent is extended or adjusted under 35 U.S.C. 154(b) by 0 days.

(21) Appl. No.: 09/438,704

(22) Filed: Nov. 10, 1999

(51) Int. Cl.[7] ..... F21V 21/00
(52) U.S. Cl. ..... 362/249; 362/250
(58) Field of Search ..... 362/252, 250, 362/396, 285, 418, 427, 806, 249, 808; 428/9, 12

(56) References Cited

U.S. PATENT DOCUMENTS 5,629,057 * 5/1997 Wang ..... 428/9
6,070,991 * 6/2000 Rumpel ..... 362/249
6,135,617 * 10/2000 Lai ..... 362/249

* cited by examiner

*Primary Examiner*—Sandra O'Shea
*Assistant Examiner*—Hargobind S. Sawhney
(74) *Attorney, Agent, or Firm*—Pro-Techtor International Services

(57) ABSTRACT

A plastic skeleton with folding structure is disclosed. The plastic skeleton includes a plurality of first arc skeletons, a plurality of second arc skeletons, and a plurality of pivot joints. Each first arc skeleton and each second arc skeleton have a shape of arc with 90 degrees, and are joint together by a respective pivot joint. One first arc skeleton, one second arc skeleton, and one pivot joint forms a plastic frame, which has a shape of arc with 180 degrees when expanding, and has a shape of arc with 90 degrees when folded. The plastic skeleton is easily folded to store with less space.

8 Claims, 9 Drawing Sheets

FOLDING PLASTIC SKELETON

FIELD OF THE INVENTION

The present invention relates to a plastic skeleton decoration, and more specifically, to a folding plastic skeleton structure, which expands to a big circle and is folded as an arc structure so as to save the space and more easily to store.

BACKGROUND OF THE INVENTION

A variety of plastic skeleton decorations with lamps have been widely used to hang on the trees or under the eaves in all kinds of celebration to enhance the sense of vision at night. The decoration generally comprises an arc skeleton structure with a puppet or an angle placed inside, which is illuminated by lamps. Those conventional decorations, however, need larger space to store and are mostly used to hang on the wall without further versatility.

SUMMARY OF THE INVENTION

An object of the present invention is to provide a folding plastic skeleton, which can expand to a larger semicircular body and be folded as a smaller arc structure to save the space and more easily to store.

Another object of the present invention is to provide a folding plastic skeleton, which can be connected with another folding plastic skeleton to construct various structures with a pretty pattern to hang on the wall or under the eaves, and further more, uses an ancillary rod to fix at the region where two skeletons are pivotally joint to allow the whole structure to stand as a wall in order to increase the range of utility.

A further object of the present invention is to provide a folding plastic skeleton, which has a plurality of fix rings to insert the lamps, and a plurality of reverse columns are interlaced at the inner edges to entangle the wires and prevent the wires from being randomly arranged. Therefore, the appearance becomes more pretty and the safety is increased.

Other features and advantages of the invention will become apparent from the following description of the invention, which refers to the accompanying drawings.

DETAILED DESCRIPTION OF THE PREFERRED EMBODIMENTS

Figure 1:
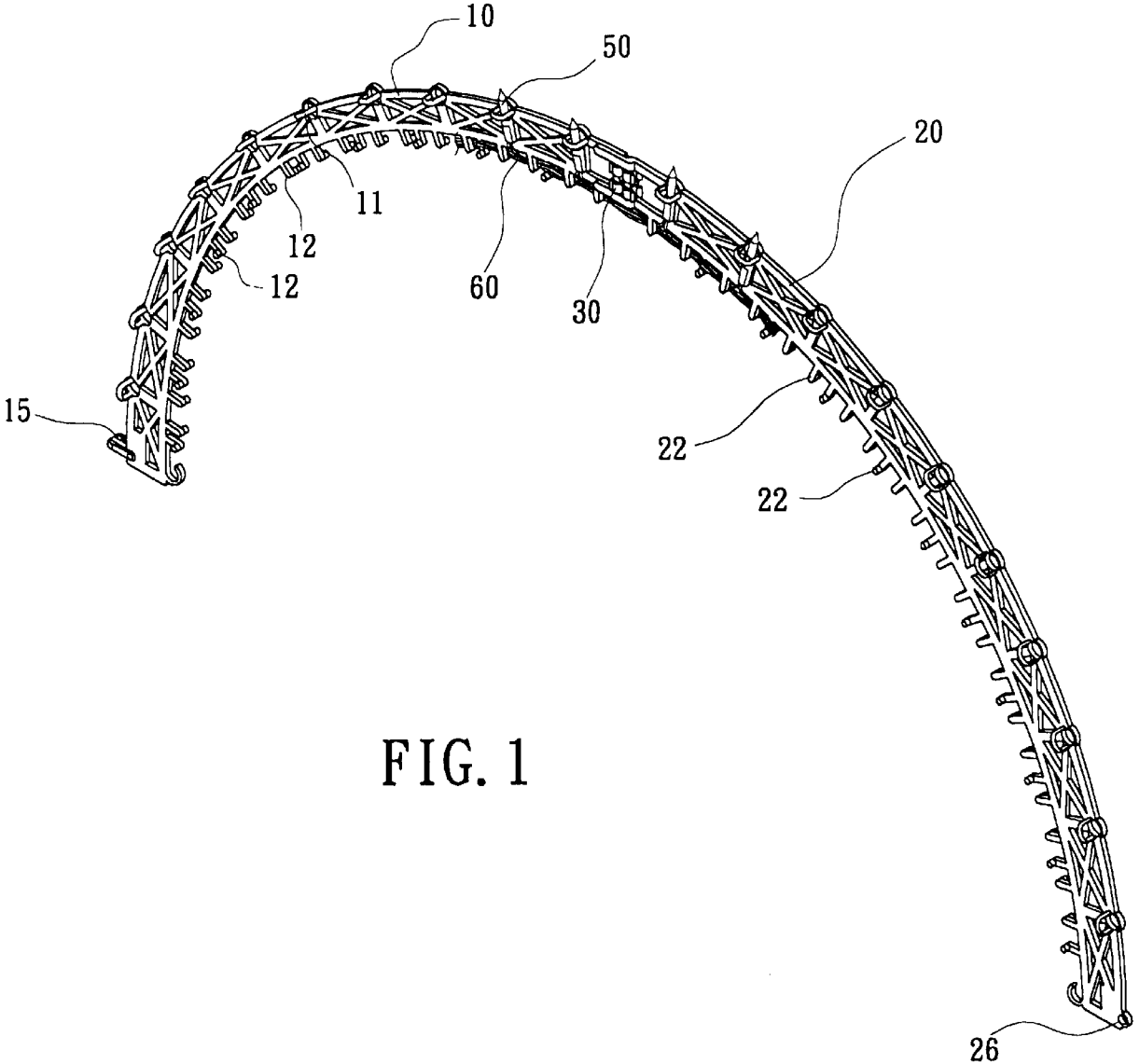
FIG. 1 shows a three-dimensional schematic diagram of a folding plastic skeleton according to the present invention.
Figure 2:
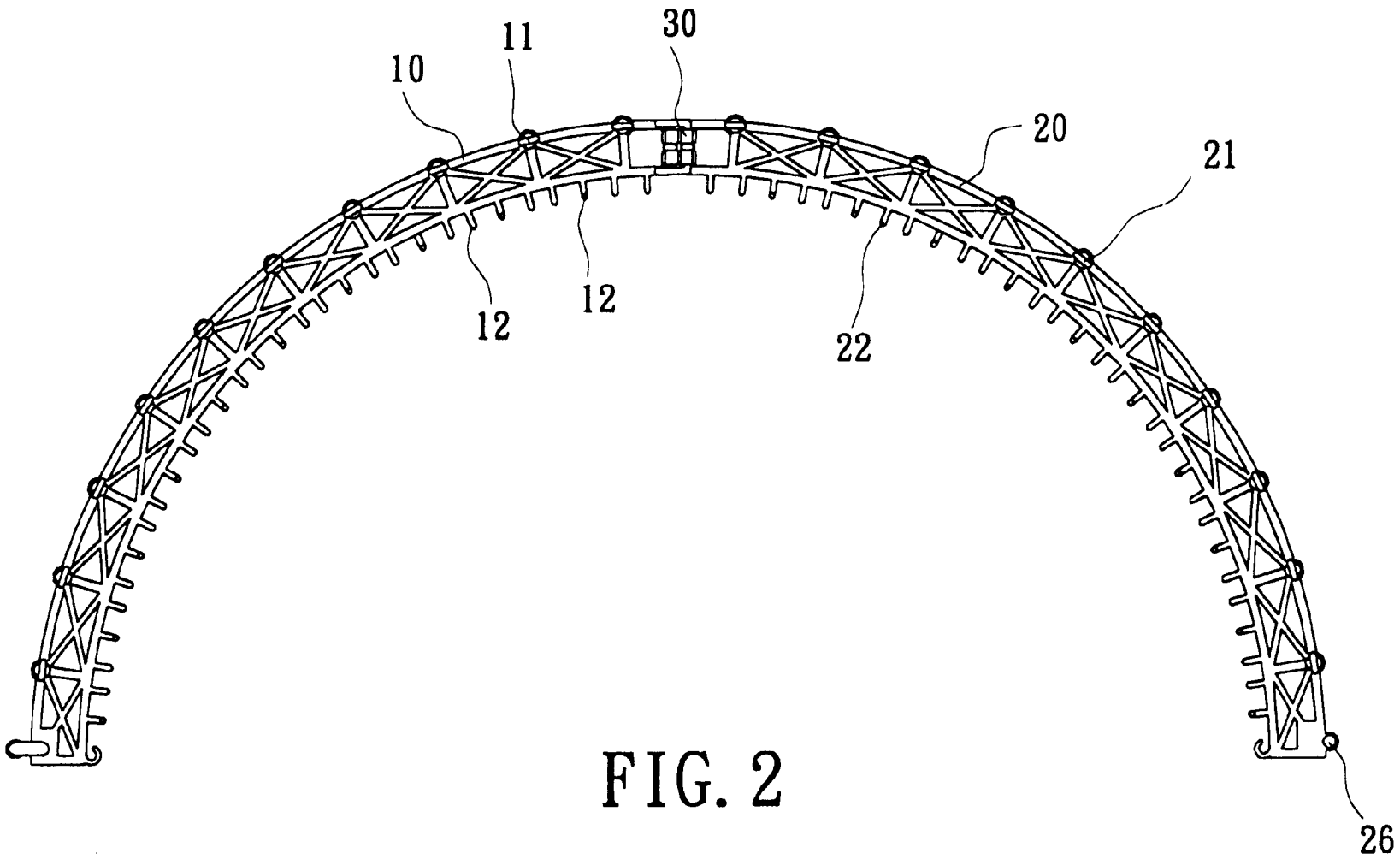
FIG. 2 is a side view of the folding plastic skeleton according to the present invention.

With reference to FIGS. 1 and 2, the folding plastic skeleton of the present invention includes two arc plastic skeletons 10 and 20, and a pivot joint 30. The two arc plastic skeletons 10 and 20 are two arc frames with about 90 degrees. The pivot joint 30 is placed between the two arc plastic skeletons 10 and 20 such that the folding plastic skeleton forms a larger semicircular decoration when expanding, and forms a smaller arc frame with only 90 degrees. Therefore, the appearance becomes more pretty and the safety is increased.

Figure 3:
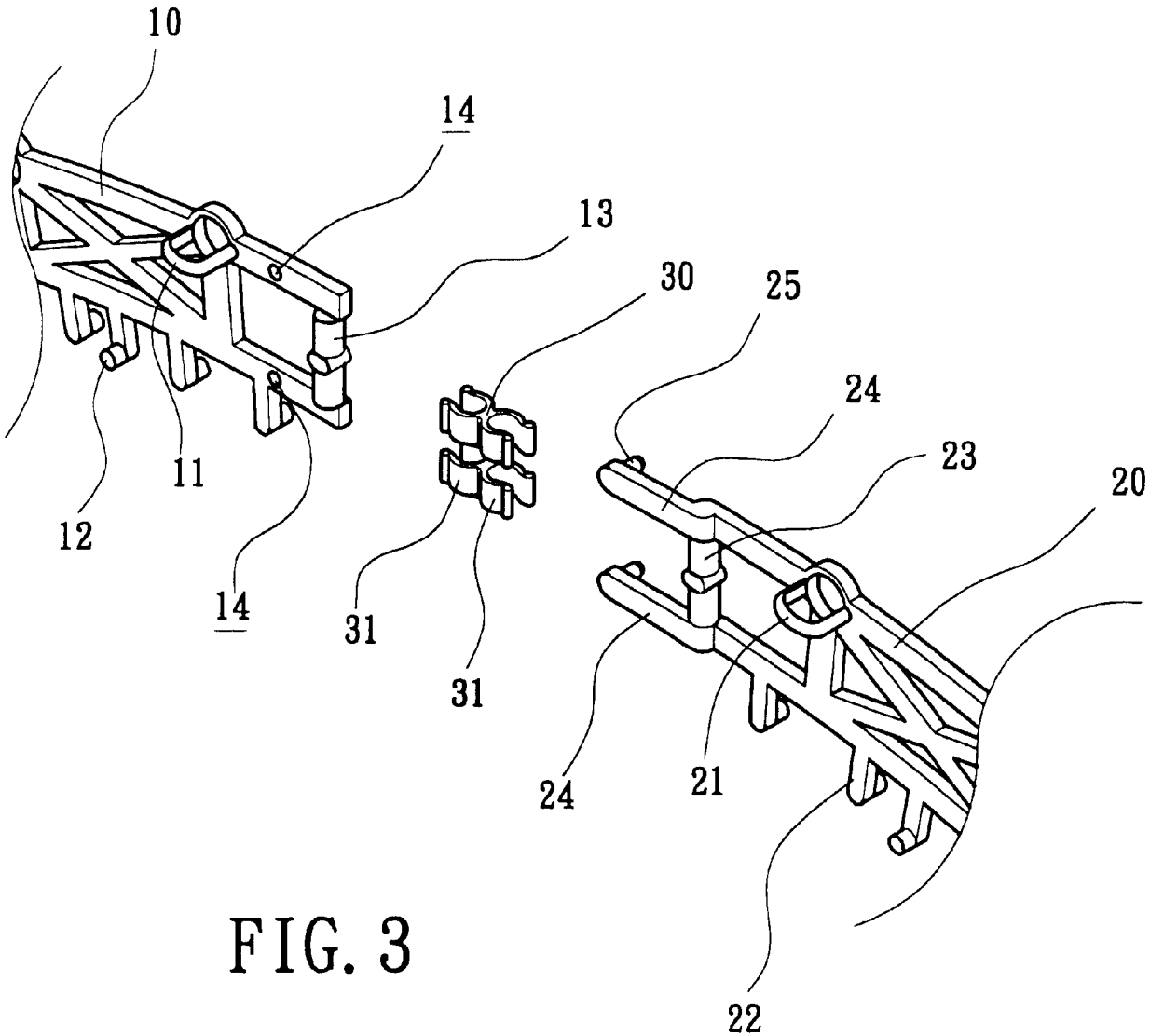
FIG.3 is an exploded diagram of part of the folding plastic skeleton according to the present invention.

The detailed structure of the present invention is described in the following description. The two arc plastic skeletons 10 and 20 are two arc frames with about 90 degrees. A plurality of fix rings are included in the two arc plastic skeletons 10 and 20 to insert the lamps, and a plurality of reverse columns are interlaced at the inner edges to entangle the wires and prevent the wires from being randomly arranged. Therefore, the appearance becomes more pretty and the safety is increased. The structures of the two arc plastic skeletons 10 and 20 are similar except the joint structures to joint with the pivot joint 30. With reference to FIG. 3, the arc plastic skeleton 10 forms a first pivot rod 13 and two connecting holes 14 at one end. The arc plastic skeleton 20 forms a second pivot rod 23 and two protruding rods 24 with two protruding columns 25, respectively, at one end. The two connecting holes 14 are coordinated with the two protruding columns 25 to joint together in order to enforce the rigidity of the folding plastic skeleton and prevent from being further folded. Another end of the arc plastic skeleton 10 forms a connecting column 15 at the outer edge (as shown in FIG. 1) and another end of the arc plastic skeleton 20 forms a joint hole 26 at the outer edge. The connecting column 15 and the joint hole 26 are used to joint the first stage of plastic skeleton and the second stage of plastic skeleton (as shown in FIG. 5) to form an arc decoration with desired outlook to enhance the sense of vision.

Figure 4:
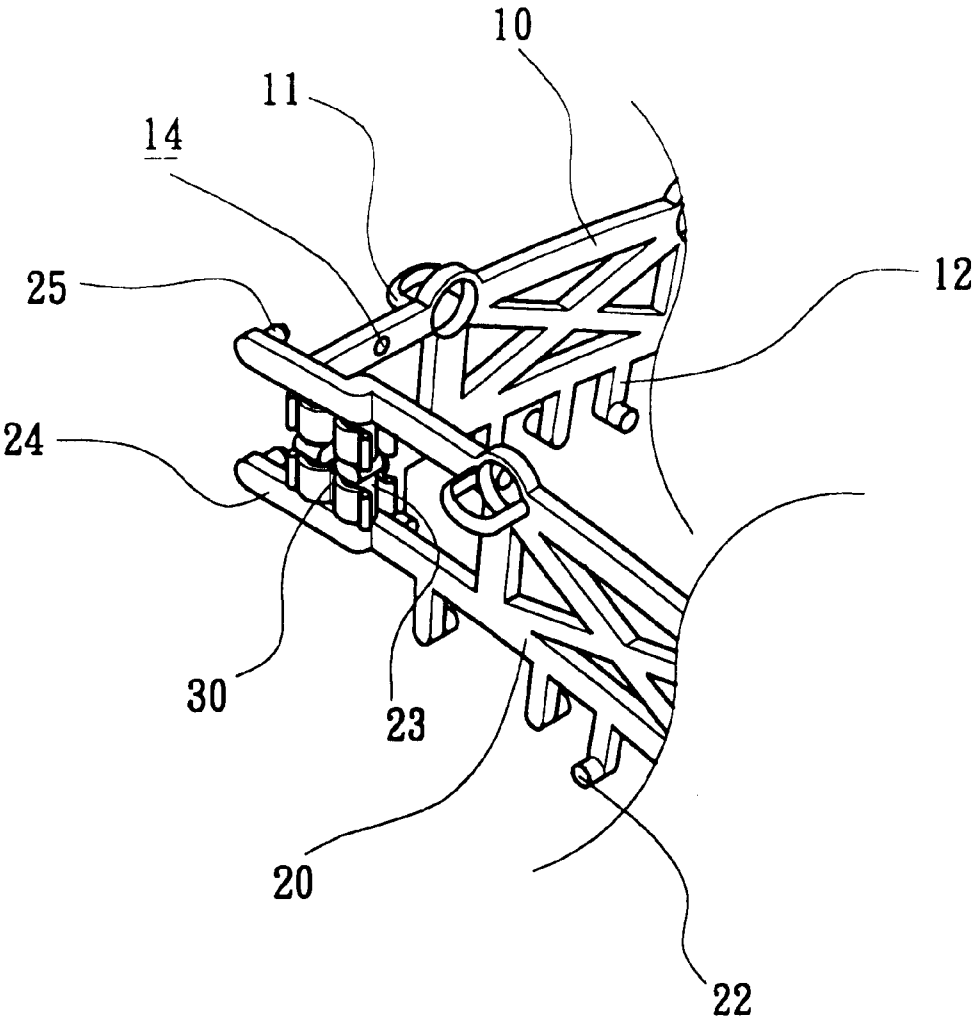
FIG. 4 shows a three-dimensional schematic diagram of a folding plastic skeleton when folded according to the present invention.

With reference to FIG. 3, two ends of the pivot joint 30 form two pivot rings 31, respectively. The pivot ring 31 is a C shape structure to clamp the first pivot rod 13 of the arc plastic skeleton 10 and the second pivot rod 23 of the arc plastic skeleton 20 so as to fold the skeleton (as shown in FIG. 4) or expand the skeleton (as shown in FIG. 1).

Figure 5:
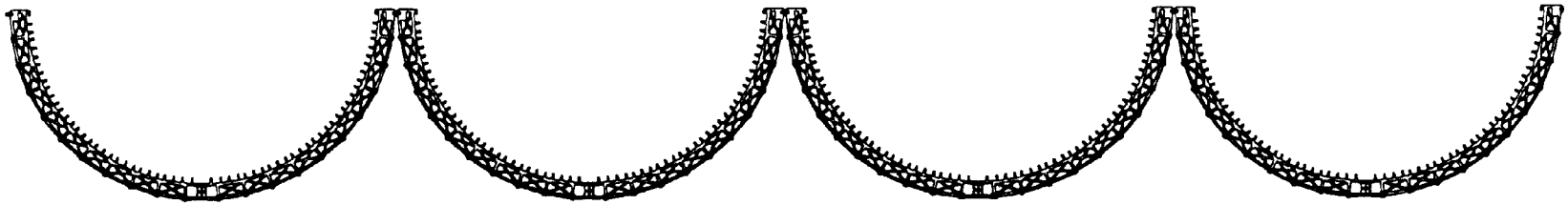
FIG. 5 shows a first embodiment of the folding plastic skeleton according to the present invention.
Figure 6:
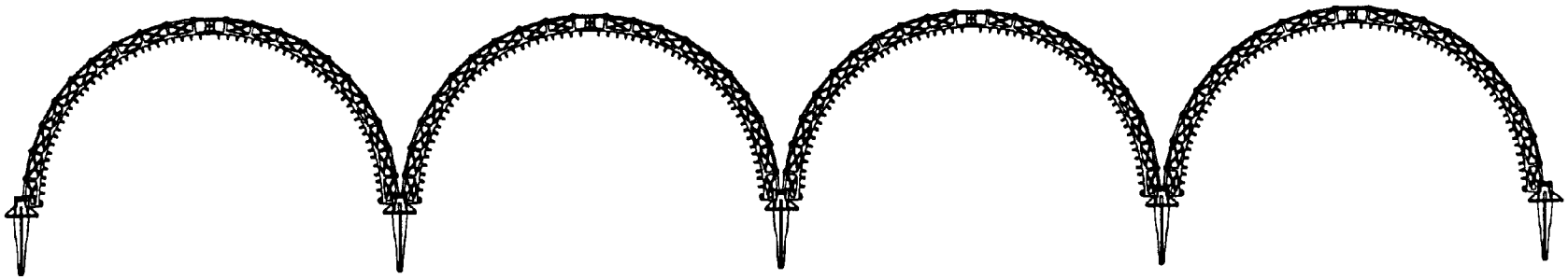
FIG. 6 shows a second embodiment of the folding plastic skeleton according to the present invention.

With reference to FIG. 5, a plurality of plastic skeletons is connected. A plurality of Christmas lamps is practically mounted on the plastic skeleton to form a lamp decoration frame with a semicircular shape to achieve the effect of decoration. With reference to FIG. 6, an ancillary rod is coordinated to fix at the region where two plastic skeleton are joint so as to form a series of arcs connected together, which can be placed around the house as the fence and mounted with Christmas lamps to enhance the sense of vision at night.

In the embodiment of the present invention, the two plastic skeletons are arc frames with 90 degrees. Three arc frames with 60 degrees can also implement the plastic skeleton such that the volume of the plastic skeleton when folded is further reduced. Similarly, more arc plastic skeletons as desired are allowed.

Figure 7:
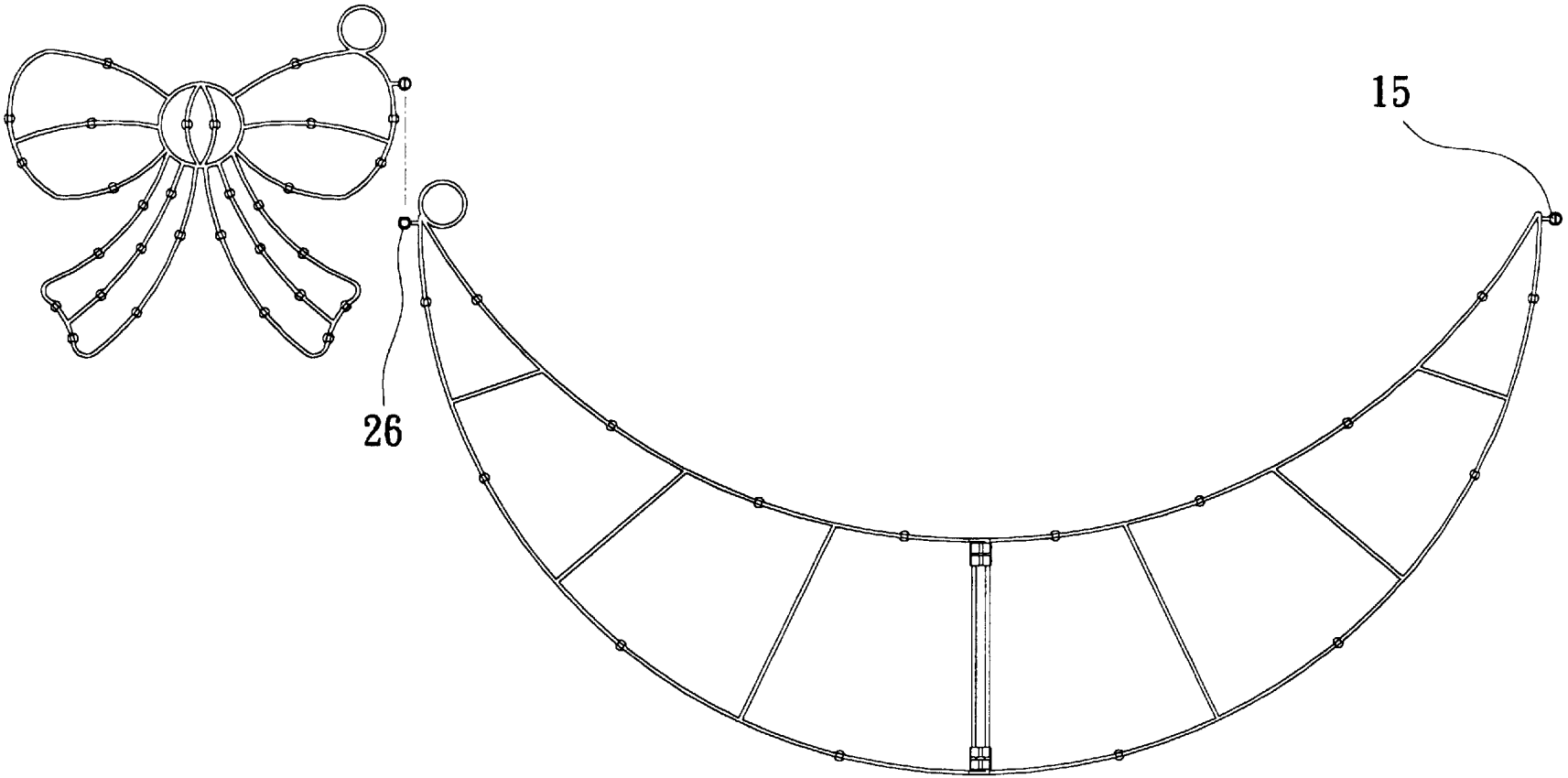
FIG. 7 shows a third embodiment of the folding plastic skeleton with bow according to the present invention.
Figure 8:
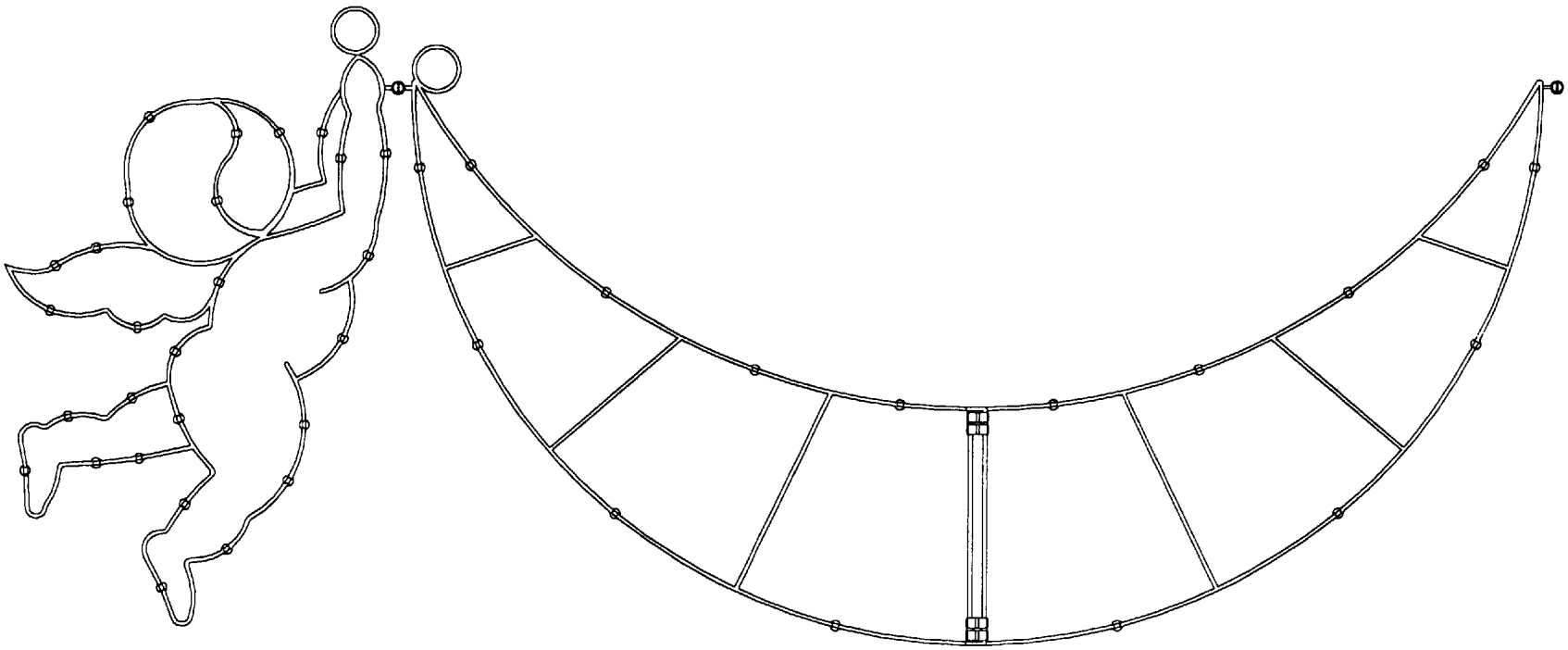
FIG. 8 shows a fourth embodiment of the folding plastic skeleton with angle according to the present invention.
Figure 9:
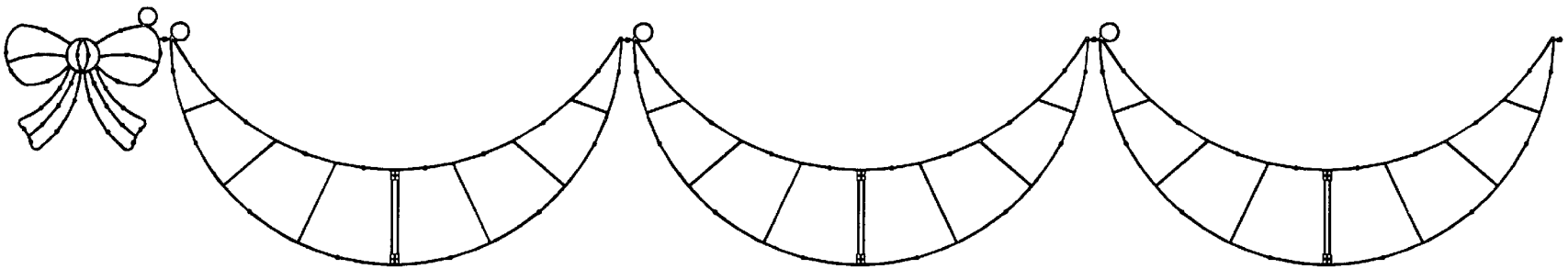
FIG. 9 shows a fifth embodiment of the folding plastic skeleton according to the present invention.

There are another three embodiments with the horn folding plastic skeleton according to the present invention. With reference FIG. 7, the folding plastic skeleton includes two horn plastic skeletons and pivot join. The connecting column 15 is used to joint the bow (as shown in FIG.7) or angle (as shown in FIG. 8). The connection column 15 and the joint hole 26 are used to the first stage of horn plastic skeleton and the second stage of horn plastic skeleton (as shown in FIG. 9) to form an horn decoration with desired outlook to enhance the sense of vision.

Although only the preferred embodiments of this invention were shown and described in the above description, it is requested that any modification or combination that come within the spirit of this invention be protected.

What is claimed is:

1. A folding plastic skeleton, comprising a plurality of first arc skeletons, a plurality of second arc skeletons, and a plurality of pivot joints, wherein said folding plastic skeleton is characterized as that said pivot joint comprises two C openings at two ends to clamp a first pivot rod of said first arc skeleton and a second pivot rod of said second arc skeleton, two protruding rods of said second arc skeleton form two protruding columns at two ends, respectively, and said first arc skeleton comprises two connecting holes.

2. The folding plastic skeleton as claimed in claim 1, wherein said first arc skeleton and said second arc skeleton form two arcs with 90 degrees.

3. The folding plastic skeleton as claimed in claim 1, further comprising at least one said first arc skeleton and one said second arc skeleton, which have arcs of a same degrees to form a semicircle when said first arc skeleton and said second arc skeleton expand.

4. The folding plastic skeleton as claimed in claim 1, further comprising at least one said first arc skeleton and one said second arc skeleton, which have arcs with different degrees to form a semicircle when said first arc skeleton and said second arc skeleton expand.

5. The folding plastic skeleton as claimed in claim 1, wherein said two protruding rods of said second arc skeleton are coordinated with said two connecting holes of said first arc skeleton, respectively, so that said two protruding columns insert into said two connecting holes to enhance rigidity of said folding plastic skeleton.

6. The folding plastic skeleton as claimed in claim 1, wherein said first arc skeleton and said second arc skeleton comprise a plurality of fix rings each holding and fixing a lamp.

7. The folding plastic skeleton as claimed in claim 1, wherein said first arc skeleton and said second arc skeleton comprise a plurality of reverse columns at respective inner edges, which are interlaced to entangle wires so as to prevent said wires from being random arranged.

8. The folding plastic skeleton as claimed in claim 1, wherein said first arc skeleton comprises a connecting column at an end opposite to said end with said connecting holes, and said second arc skeleton comprises a joint hole, which is coordinated with said connection column to connect a plurality of said first arc skeletons and a plurality of said second arc skeletons in order to enhance sense of vision.

* * * * *